United States Patent [19]

Lang et al.

[11] 4,304,175

[45] Dec. 8, 1981

[54] APPARATUS FOR SECURING A GRILLE TO AN AIR CONDITIONING UNIT

[75] Inventors: Richard D. Lang, Chittenango; Theodore S. Bolton, Liverpool, both of N.Y.

[73] Assignee: Carrier Corporation, Syracuse, N.Y.

[21] Appl. No.: 151,037

[22] Filed: May 19, 1980

[51] Int. Cl.[3] ..... F24F 1/02

[52] U.S. Cl. ..... 98/94 AC; 62/262; 98/99.8; 98/114; 98/121 R; 160/369; 312/101; 312/223

[58] Field of Search ..... 312/100, 101, 223, 257 SK, 312/111; 62/262, 298; 52/817; 160/369; D23/141, 143, 164; 98/885, 94, 99.8, 99.6, 114, 121 R; 138/159; 403/408

[56] References Cited

U.S. PATENT DOCUMENTS

| | | | |
|---|---|---|---|
| 1,958,342 | 5/1934 | Johnson | 98/99.8 X |
| 1,986,981 | 1/1935 | Ross | 403/408 X |
| 2,829,023 | 4/1958 | Roome | 312/257 SK |
| 2,945,357 | 7/1960 | MacLeod | 98/94 AC X |
| 3,253,874 | 5/1966 | Czech | 312/223 X |
| 3,715,971 | 2/1973 | Moyer | 98/114 X |
| 3,915,530 | 10/1975 | Anderson et al. | 62/298 X |

*Primary Examiner*—Albert J. Makay
*Assistant Examiner*—Harold Joyce
*Attorney, Agent, or Firm*—J. Raymond Curtin; Robert P. Hayter

[57] ABSTRACT

Apparatus is disclosed for forming a subassembly for use with an air conditioning unit. This subassembly is formed from a casing having a grille attached thereto. Means are provided for securing the grille to the casing from the interior of the casing with said securing means being not directly observable from a position exterior of the unit.

6 Claims, 4 Drawing Figures

APPARATUS FOR SECURING A GRILLE TO AN AIR CONDITIONING UNIT

BACKGROUND OF THE INVENTION

1. Field of the Invention

This invention relates in general to means for securing a grille to an air conditioning unit. More specifically, this invention concerns a subassembly for allowing a grille to be attached to a casing from within the casing and with the means for securing the grille to the casing being hidden from view.

2. Prior Art

Air conditioning units which are commonly used for light commercial applications such as hotels, dormitories and office buildings often are of the type known as a packaged terminal air conditioner. These packaged terminal air conditioners extend through the wall of the enclosure and normally have a condensing section located in communication with ambient air for discharging heat energy. An evaporator section of the unit is provided in communication with the enclosure air for conditioning said air as it is drawn through the unit.

Room air conditioning units and other self-contained units are also used to condition the air for residences and small businesses. Room units may either be mounted in a window or extend through the wall such that a portion of the unit is located to communicate with ambient air. These units, both the packaged terminal air conditioner type and the room air type, are usually spaced along an exterior wall of the enclosure to be conditioned. The unit is so positioned such that the heat energy to be dissipated from the enclosure to be cooled may be discharged to the ambient air. By communicating the outdoor or condensing section of the air conditioning unit with ambient air heat absorbed by refrigerant in communication with the indoor air may be discharged to the outdoor air. Hence, it is the necessity for each of these units that ambient air be circulated in communication with the condenser to absorb heat energy being discharged from the air conditioning unit when it is operating to supply cooled air to an enclosure.

In any applications extending through a wall such as casement or packaged terminal air conditioning type units, the unit may be located in a building numerous floors in height. The installation of such a unit normally involves a casing being inserted through an opening constructed in the exterior wall, said casing being adapted to have attached thereto a grille for covering the spaced defined by the casing for the air flow to enter the unit. When these units are spaced from the ground it is particularly desirable that the grille be attached to the casing from inside the unit such that to repair and initial installation may both be accomplished from inside the building. Additionally, by the assembly being from within the unit it is possible to avoid, during construction of the building, the necessity for additional elevated work outside of the building for installation of air conditioning units.

Since the exterior surface of the unit is visible on the outside of the enclosure it also desirable to build a visually attractive unit. To accomplish this result, the invention as disclosed herein incorporates means for securing the grille to the casing without any screws or fasteners being visible from outside the building. Additionally, to aid in the attractive appearance of the unit, the grille is formed from aluminum which does not rust or discolor with exposure to the elements. The fastening means for securing the grille to the casing is within the unit, consequently, the potential of rusting screws being visible from the exterior of the unit is not present.

SUMMARY OF THE INVENTION

An object of the invention is to provide a subassembly for an air conditioning unit including a casing and a grille.

A further object of the present invention is to provide means for securing a grille to a casing such that the assembly of the two may be accomplished from within the casing.

A further object of the present invention is to provide a combination casing and grille wherein the means for securing the grille to the casing is not directly visible by an observer exterior to the enclosure in which the air conditioning unit is to be mounted.

Another object of the present invention is to provide a safe, economical, easy to manufacture and easy to assemble combination grille and casing assembly for use with an air conditioning unit.

Other objects will be apparent from the description to follow and from the appended claims.

The above objects are achieved according to a preferred embodiment of the present invention by the provision of an assembly for use with an air conditioning unit having at least one exterior surface. The assembly includes a casing having a plurality of walls defining a chamber wherein at least a portion of the components of the air conditioning unit may be located. The casing includes a casing border forming a portion of the exterior surface of the unit, said border including a plurality of casing segments extending inwardly from the casing walls. Each casing segment has attached to the interior edge thereof and angled inwardly towards the interior of the chamber defined by the walls a casing flange. A passageway for the flow of air into the unit is defined by the casing border segments.

A grille is mounted to the casing to cover the passageway defined by the casing border segments, said grille having grille flanges angled from a grille face such that the grille flanges extend toward the interior of the chamber formed by the casing. Each grille flange extends generally parallel to a corresponding casing flange such that the grille may be secured to the casing by attaching the grille flange to the casing flange. A combination screw, nut and spacer arrangement is provided such that the appropriate flanges may be secured to each other while preventing metal to metal contact therebetween and with said fastening arrangement being within the unit such that it is both accessible from inside the unit and not directly observable from a position exterior of the building when the unit is installed.

DESCRIPTION OF THE PREFERRED EMBODIMENT

The embodiment herein described will be in reference to a grille and casing subassembly for use with a packaged terminal air conditioning unit. It is to be understood that the invention herein has like applicability to any type of self-contained air conditioning unit extending through the wall such that the grille is mounted on the exterior of the building. It is to be further understood that this invention has applicability to other types of air conditioning units and air handling units. This invention may also be applied to grille assemblies for the introduction and discharge of air from an enclosure.

Figure 1:
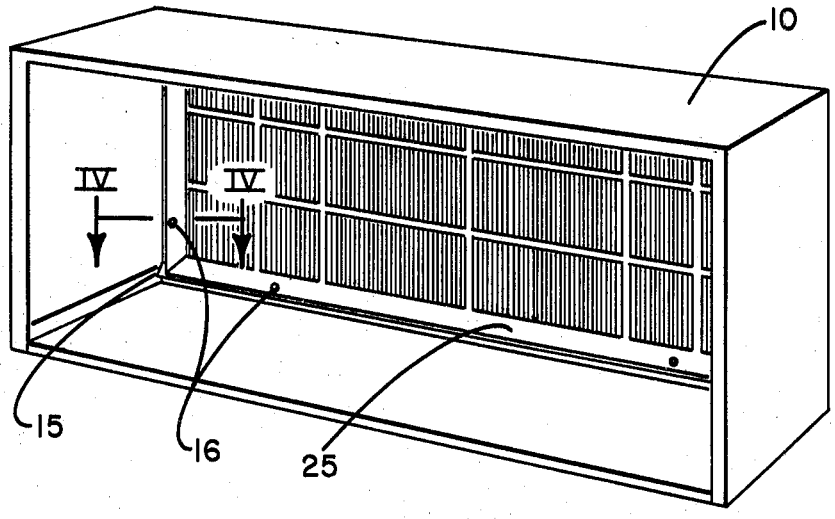
FIG. 1 is an isometric view of a casing and grille as seen from the inside.
Figure 2:
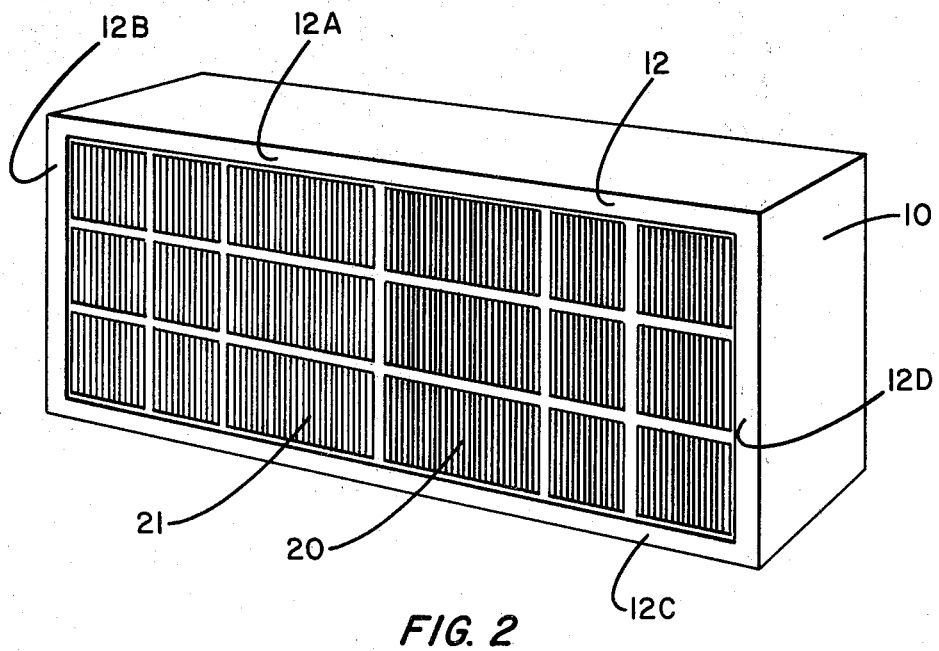
FIG. 2 is a view of the same casing and grille assembly as in FIG. 1 viewed from the outside.

Referring first to FIGS. 1 and 2, there may be seen a subassembly consisting of casing 10 and grille 20. Casing 10 has four walls defining a chamber therein. This chamber is normally adapted to have components making up a portion of the air conditioning unit inserted therein. As specifically seen in FIG. 2, the subassembly has an exterior surface consisting of grille face 21 and casing border 12. Casing border 12 is comprised of four casing border segments 12A through 12D, one segment corresponding to each of the four casing walls. These casing segments extend inwardly from the casing walls and form a portion of the exterior surface of the unit. A passageway for air flow into and out of the chamber defined by the walls is formed between the interior edges of the casing border segments. It is this passageway that grille 20 is mounted to cover, grille face 21 specifically extending between the interior edges of the four casing border segments.

As can be seen in FIG. 2, the only portions of the assembly visible from the exterior are the grille face 21 and four casing border segments 12A through 12D. In a typical application, the grille face 21 may be manufactured from aluminum while the casing is manufactured from steel. The manufacturing of the grille face from aluminum allows for a material which is not subject to rusting or other appearance changes as the result of environmental application. The provision of no screws or other fastening device at the front of the unit additionally not only aids in the appearance of these units but further serves to prevent rust stains or other blemishes to the surface of the unit caused by the weatherization, rusting or oxidizing of such fastening means.

Formed on the interior side of grille 20, extending inwardly from grille face 21 toward the interior of the chamber defined by the casing, are grille flanges 25. These flanges are mounted on each of the four sides of the grille. Additionally, extending inwardly toward the interior of the chamber defined by the casing walls from the interior edge of the casing border segments are casing flanges 15. As may be seen in FIG. 1, these two sets of flanges are generally parallel and screws 16 are shown for securing the grille flange to the casing flange.

Figure 3:
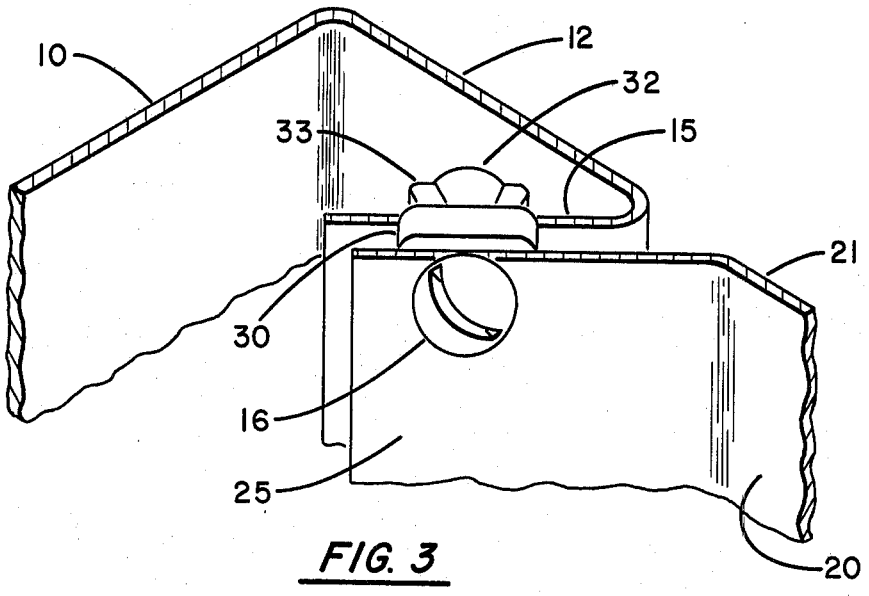
FIG. 3 is an isometric view showing the relationship between the casing flanges and grille flanges.
Figure 4:
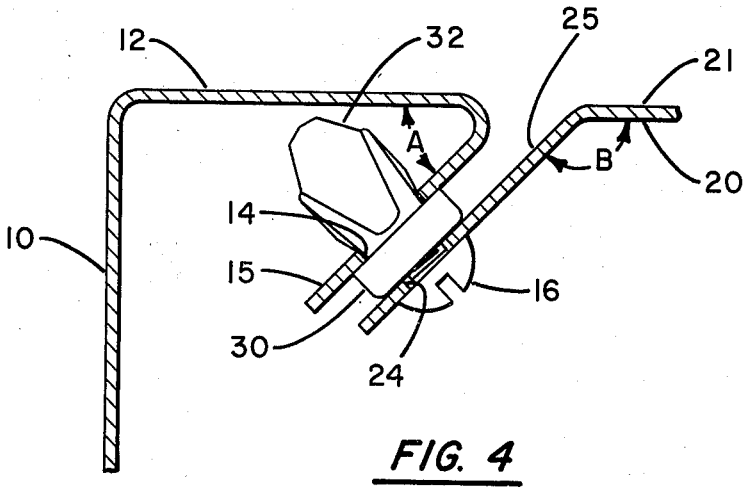
FIG. 4 is a sectional view of the juncture between the casing and grille taken at line IV—IV as shown in FIG. 1.

Referring now to FIGS. 3 and 4, the specific details of the fastening of the grille to the casing may be seen. Casing wall 10 is shown having casing border segment 12 angled therefrom. Casing flange 15 is shown attached to the end of border segment 12 such that the casing wall 10, border flange 12 and casing flange 15 may be all formed from a single piece of material. Additionally, grille 20 is shown having grille face 21 and grille flange 25 again both formed from a single piece of material.

Hole 14 is provided in casing flange 15 as is hole 24 in grille flange 25. A fastener 32 having a spacer portion 30 and a flare portion 33 is shown. This fastener is assembled to the casing flange by inserting the flare portion therethrough. Upon insertion, the spacer portion is on one side of the casing flange and the flare portion is on the other side of the casing flange. Screw 16 is then inserted through hole 24 in grille flange 25 through spacer portion 30 into flare portion 33 of fastener 32. When inserted screw 16 is tightened, the screw head acting to secure the grille flange 25 to spacer 30 to casing flange 15 to flare portion 33 of fastener 32. Hence, the grille is secured to the casing in a spaced fashion.

By the utilization of spacer portion 30 the fastening means accomplishes several purposes. Since the grille may be aluminum and the casing steel, the provision of a spacer made from a dielectric material such as plastic serves to electrically isolate the aluminum component from a steel component therby preventing galvanic corrosion. Additionally, the spacing of the grille flange from the casing flange acts to eliminate any potential capillary action which may act to maintain water between the two surfaces. By the elimination of this potential capillary action, the maintenance of constant water between the two and the potential for corrosion caused thereby is eliminated.

As can be seen in FIG. 4, the angle formed between the casing border 12 and casing flange 15 is designated as angle A. Additionally, the angle between the grille face 21 and grille flange 25 is designated as angle B. Since the exterior surface of the unit formed by border segments 12 and grille face 21 is generally parallel, angle A plus angle B equals approximately 180°. Although the unit is shown with angle A being an acute angle and angle B being an obtuse angle, it is possible for the angles to be reversed and to accomplish the same purpose herein.

By angling the flanges toward the interior of the chamber formed by the casing, fastener 32 and screw 16 are located in the inteior of the unit. Since fastener 32 may be inserted into hole 14 of casing flange 15, the fastener is secured in that position. Hence, upon assembly of the grille to the casing, the assembler may insert the appropriate fasteners into each of the holes of the various casing flanges. The aluminum grille is then placed in position from the inside of the unit against the fasteners and screws inserted through the grille into the fasteners to secure the two components in position. Consequently, it is possible for the operator to assemble the unit from the inside. Additionally, the provision of the angled flanges allows fastener 32 and screw 16 to be mounted interior of the exterior surface of the unit. By the selection of the angle of the flange and the distance along the flange the fastener and screw are inserted it is possible to locate the securing means sufficiently distant from the exterior surface of the unit that it is not directly observable from the exterior of the unit. Hence, not only does this fastening arrangement serve to allow the unit to be assembled from the inside but it provides a pleasant exterior appearance since the fastening means is not observable.

The invention herein has been described in reference to a particular embodiment thereof. It is to be understood that variations and modifications can be effected in the spirit and scope of the invention.

We claim:

1. An assembly for use with an air conditioning unit having at least one exterior surface which comprises:

a casing having a plurality of walls defining a chamber wherein at least a portion of the components of the air conditioning unit may be located, said casing including a casing border forming a portion of the exterior surface of the unit, said casing border including a plurality of casing border segments each extending inwardly from the walls of the casing generally in the plane of the exterior surface of the unit, said casing border segments defining an air flow passageway therebetween and casing flanges connected to the inward edge of at least a portion of border segments, said casing flanges forming an acute angle with the casing border segments and extending into the interior of the chamber defined by the casing;

a grille for allowing air to communicate with the chamber formed by the casing walls, said grille including a grille face forming a portion of the exterior surface of the assembly, said grille face extending between the casing border segments to cover the passageway therebetween, said grille having grille flanges extending from the edges of the grille face into the interior of the chamber defined by the walls of the casing, said grille flanges being generally parallel to the casing flanges; and means to secure the casing flanges to the grille flanges such that the grille face and the border segments form the exterior surface of the assembly and the means for securing the grille flanges to the casing flanges is not directly observable when viewing the exterior surface of the assembly and such that the grille may be secured to the casing from within the casing.

2. The apparatus as set forth in claim 1 wherein the angle formed between a casing border segment and a casing flange plus the angle formed between the grille face and a grille flange totals approximately 180°.

3. The apparatus as set forth in claim 1 wherein the means for securing the casing flanges to the grille flanges comprises a screw extending through an opening in both flanges, a spacer located between the flanges and a screw receiving member into which the screw is threaded whereby the screw and receiving member secure the casing flange to the grille flange with the spacer therebetween.

4. Apparatus for securing a grille face to the casing of an air conditioning unit, said grille face forming at least a portion of the exterior surface of the unit and said casing having four walls defining a chamber wherein at least a portion of the components of the air conditioning unit may be located which comprises:

four border segments each being connected at one end to a wall of the casing, said border segments being located generally in the plane of the exterior surface of the unit and extending inwardly from the walls of the casing;

four casing flanges each attached to one of the border ssegments at the internal edge thereof and each casing flange forming an acute angle with a border segment and extending toward the interior of the chamber formed by the casing;

four grille flanges each attached to an edge of the grille face, said grille flanges being angled from the grille face toward the interior of the chamber defined by the casing, said grille flanges each being generally parallel with a corresponding casing flange; and means for securing at least one of the grille flanges to the corresponding casing flange whereby the exterior surface of the unit includes the grille face and the border segments and wherein the means for securing the grille flanges to the casing flanges is not directly observable when viewing the exterior surface of the unit and such that the grille may be secured to the casing from within the casing.

5. The apparatus as set forth in claim 4 wherein the casing, the border segments and the casing flanges are formed from sheet steel, and wherein the grille face and grille flanges are formed from a single sheet of aluminum.

6. The apparatus as set forth in claim 5 wherein the means for securing includes a dielectric spacer for preventing contact between the steel casing flanges and the aluminum grille flanges.

* * * * *